US005496034A

United States Patent [19]

Maruko et al.

[11] Patent Number: 5,496,034

[45] Date of Patent: Mar. 5, 1996

[54] THREAD WOUND GOLF BALL

[75] Inventors: Takashi Maruko; Shinichi Kakiuchi, both of Yokohama, Japan

[73] Assignee: Bridgestone Sports Co., Ltd., Tokyo, Japan

[21] Appl. No.: 352,633

[22] Filed: Dec. 9, 1994

[30] Foreign Application Priority Data

Dec. 9, 1993 [JP] Japan ..... 5-340861

[51] Int. Cl.[6] ..... A63B 37/08; A63B 37/12

[52] U.S. Cl. ..... 273/216; 273/227; 273/231; 273/235 R; 273/DIG. 22

[58] Field of Search ..... 273/231, 235 R, 273/222, 226, 227, 228, 230, DIG. 22, 216

[56] References Cited

U.S. PATENT DOCUMENTS 5,033,749 7/1991 Kakiuchi et al. ..... 273/231 X
5,328,959 7/1994 Sullivan ..... 273/235 R X
5,338,038 8/1994 Cadorniga ..... 273/231 X
5,368,304 11/1994 Sullivan et al. ..... 273/235 R X
5,415,937 5/1995 Cadorniga et al. ..... 273/235 R X

*Primary Examiner*—George J. Marlo
*Attorney, Agent, or Firm*—Sughrue, Mion, Zinn, Macpeak & Seas

[57] ABSTRACT

A thread-wound golf ball having a liquid center wound by rubber thread and further having a cover placed thereon, characterized by using as the major component of the cover an ionomer whose JIS-C hardness is 70–85, making the thickness of the cover 1.0–1.8 mm, making the outside diameter of the liquid center 27–30 mm, making the center bag hardness of the liquid center 44–62 (in terms of JIS-A hardness), and making the thickness of the center bag 1.8–2.3 mm.

1 Claim, No Drawings

THREAD WOUND GOLF BALL

BACKGROUND OF THE INVENTION

1. Field of the Invention

The present invention relates to a thread-wound golf ball having its liquid center wound by rubber thread and further having a cover placed thereon. 2. Description of the Prior Art Among the thread-wound golf balls are the one having its center wound by rubber thread and having a cover placed thereon and the one having its solid center wound by rubber thread and having a cover placed thereon, and each is divided into thread-wound balata ball and thread-wound Surlyn ball according to the kind of the cover material.

The thread-wound balata ball that uses balata as the cover material is superior in controllability and hit sense but, as compared with the thread-wound Surlyn ball that uses ionomer resin as the cover material, has a larger spin amount, a smaller run, and as the result, is poor in fly distance, and the durability of the cover is also inferior.

On the other hand, the thread-wound Surlyn golf ball is superior in the durability of the cover, but is inferior in hit sense, has a small spin amount, and is inferior in controllability.

The present invention was worked out in view of the foregoing circumstances, and is intended to provide a thread-wound golf ball with a liquid center which gives an adequate spin characteristics and as good a hit sense as the thread-wound balata ball, and maintains the inherent durability and fly distance of the thread-wound Surlyn ball.

SUMMARY OF THE INVENTION

The present inventors carried out extensive studies to achieve the above-mentioned object, and as the result, found that the thread-wound golf ball having the intended performance as mentioned above is obtained by using as the major component of the cover an ionomer resin whose JIS-C hardness is 70–85, making the thickness of the cover 1.0–1.8 mm, making the outside diameter of the liquid center 27–30 mm, making the center bag hardness of the liquid center 44–62 (in terms of JIS-A hardness), and making the thickness of the center bag 1.8–2.3 mm in a thread-wound golf ball having its liquid center wound by rubber thread and having a cover placed thereon.

DESCRIPTION OF THE PREFERRED EMBODIMENTS

For the improvement of the fly distance of the driver etc., the one with less spin is advantageous because the trajectory of the ball is not too high and the rolling (run) after dropping increases. On the other hand, as to controllability, the one having much spin is advantageous because the stopping of the ball on the green is good. Thus the spin performance is important for the performance of the golf ball, but this spin performance is determined by the degree of deformation of the ball at the time of hit and the frictional force between the ball and the club face. In the case where the impact force to the ball is large like driver shot, the amount of deformation of the ball is dominant; and on the other hand, in the case where the impact force to the ball is small like approach shot, the frictional force between the ball and the club face is dominant. The present inventors noticed this point and studied the specifications of the cover material and liquid center so that the spin is smaller than the conventional thread-wound balata ball in the shots of drivers etc. and the spin is equal in the shots of short iron etc. As the results, they found that if the hardness and thickness of the cover material are prescribed to the above-mentioned specific values and the diameter and hardness of the liquid center and the thickness of the center bag are made adequate as mentioned above, the spin performance to give a good fly distance and controllability can be obtained and the good cut resistance can be obtained, and reached the present invention.

Therefore, the present invention provides a thread-would golf gall having a liquid center wound by rubber thread and further having a cover placed thereon, characterized by using as the major component of the cover an ionomer whose JIS-C hardness is 70–85, making the thickness of the cover 1.0–1.8 mm, making the outside diameter of the liquid center 27–30 mm, making the center bag hardness of the liquid center 44–62 (in terms of JIS-A hardness), and making the thickness of the center bag 1.8–2.3 mm.

In the following, the present invention will be described in more detail, and the thread-wound golf ball of the present invention is composed of a liquid center, rubber thread, and cover.

The liquid center herein is one having the center bag filled with a liquid such as water and further with a weight adjusting agent such as barium sulfate, and its specific gravity should be 1.0–2.0, preferably 1.0–1.7.

On the other hand, as the material of the center bag, the bag rubber of liquid center ball for the ordinary golf ball, for example, natural rubber, butadiene rubber, isoprene rubber, or a mixture rubber thereof, incorporated with stearic acid, zinc white, oil, sulfur, and vulcanizer, is used for forming, but in the present invention, the outside diameter of this center bag is 27–30 mm and the thickness is 1.8–2.3 mm, and the JIS-A hardness is 44–62, preferably 48–58. If the outside diameter of the center bag is smaller than 27 mm, too much spin is experienced, and conversely, if larger than 30 mm, spin is hardly experienced, and moreover, in order to gain an adequate ball hardness, it is necessary to wind by heightening the tension of the rubber thread, and the thread breakage is increased by this and hence the working efficiency decreases. Also, if the thickness of the center bag is thinner than 1.8 mm, the strength is weak and if thicker than 2.3 mm, the hardness of the center bag is too large and excessive spin is experienced, and the object of the present invention is not achieved. Moreover, if the JIS-A hardness of the center bag is smaller than 48, the amount of back spin is too little, especially the controllability in iron shot decreases; and conversely, if it is greater than 62, too much spin is experienced in shot by the driver and this leads to a decrease in fly distance.

There are no specific restrictions on the material of the rubber thread to be wound on the above-mentioned liquid center, and it is possible to use ordinary rubber thread such as crumb rubber thread produced by kneading solid rubber and IR latex thread rubber produced from isoprene rubber (IR) latex.

The thread-wound golf ball of the present invention is one in which the rubber thread like this is wound under tension around the above-mentioned liquid center, thereby forming the rubber thread layer. In this case, if the thickness direction of the rubber thread coincides with the radical direction, the winding method is not restricted, and it is possible to wind by any known method such as random winding (or basket winding) and great circle winding, and it is possible to carry out the winding step by using any known automatic winding machine according to the winding method. Incidentally, the degree of elongation of rubber thread at the time of winding is usually 8–10 times, depending on the cross-sectional area of the rubber thread, and it is possible to set up an ordinary thickness for the thickness of the rubber thread layer according to the diameter of the center and the size of the ball (whether large ball or small ball).

In the present invention, as the cover covering this rubber thread layer, one whose major component is ionomer resin is used. As this ionomer resin, one in which at least part of the carboxylic acid groups in a binary copolymer of olefin and unsaturated carboxylic acid or a ternary copolymer of olefin, unsaturated carboxylic acid, and unsaturated carboxylic ester is neutralized with metal ions is used, and above all one in which at least part of carboxylic acid groups of a copolymer in which ethylene is used as an olefin and acrylic acid/methacrylic acid is used as an unsaturated carboxylic acid is neutralized with metal ions is preferably used.

To be concrete, those in which at least part of carboxylic acid groups of ethylene-(meth)acrylic acid copolymer and ethylene-(meth)acrylic acid-(meth)acrylic ester terpolymer is neutralized with metal ions are enumerated. As the metal, Li, N, K, Zn, etc. are used.

In the present invention, the cover is formed by using this ionomer as the major component, but in this case, it is possible to form the cover by incorporating thermoplastic resins etc. such as EVA, EAA, and polyester elastomer, according to need.

In the present invention, the above-mentioned cover should be such that its JIS-A hardness is 70–85, preferably 76–82, and its thickness is 1.0–1.8 mm. If the JIS-A hardness if smaller than 70, the resilience performance decreases, and if larger than 85, spin is hardly experienced. Also, if the cover thickness is thinner than 1.0 mm, the cut resistance decreases, and if thicker than 1.8 mm, spin is hardly experienced, and the initial velocity of the ball decreases.

The golf ball of the present invention is formed such that its overall diameter is usually 42.67 mm or so and its weight is 45.2 g or so.

EXAMPLES

In the following, the invention will be explained concretely with reference to Examples and Comparative Examples, but the invention is not restricted to the following examples.

Examples 1–5 & Comparative Examples 1–8

First, as the center bag material, one in which zinc, naphthene oil, vulcanization accelerator, and sulfur are added to natural rubber was used, and the liquid center of the specification as shown in Table 1 was prepared.

Further, in the production of the center bag, its specific gravity and hardness were adjusted by controlling the compounding amount of zinc white.

TABLE 1

| | Center diameter (mm) | Center weight (g) | Center bag Hardness | Center bag Gauge | Center bag Sp. Gr. | Liquid Compounding | Liquid Sp. Gr. |
|---|---|---|---|---|---|---|---|
| A | 28.0 | 17.8 | 48 | 2.0 | 1.34 | Water Barium sulfate | 1.65 |
| B | 29.0 | 18.7 | 56 | 2.3 | 2.23 | Water | 1.00 |
| C | 28.0 | 17.8 | 62 | 2.3 | 2.33 | Water | 1.00 |
| D | 28.0 | 16.8 | 48 | 2.0 | 1.17 | Water Barium sulfate | 1.60 |

Then, using crumb rubber thread as the rubber thread and winding around the above-mentioned liquid center by the ordinary thread winding method, the thread-wound core of the outside diameter shown in Table 2 was obtained.

On the other hand, covering the above-mentioned thread-wound core with a pair of half-shells formed by using a compound in which 5 parts by weight of titanium oxide was added to 100 parts by weight of the following ionomer resin (Himiran, Mitsui DuPont Chemical Co., Ltd.), and heat-compression molding at 140° C. for 5 minutes, the thread-wound golf balls in which the following covers A to E were formed were obtained.

Cover A

Himiran 1706/Himiran 1605=50/50 (weight ratio)

Cover hardness JIS-C 92

Cover B

Himiran 1557/Himiran 1856=75/25 (weight ratio)

Cover hardness JIS-C 89

Cover C

Himiran 1557/Himiran 1856=50/50 (weight ratio)

Cover hardness JIS-C 84

Cover D

Himiran 1650/Himiran 1856=40/60 (weight ratio)

Cover hardness JIS-C 78

Cover E

Himiran 1557/Himiran 1855/Himiran 1856=10/40/50 (weight ratio)

Cover hardness JIS-C 76

Also, for the purpose of comparison, the above-mentioned thread-wound core was covered with a pair of half-shells formed from the compound (balata cover material) of the following recipe

| | parts by weight |
|---|---|
| trans-1,4-polyisoprene | 70 |
| high styrene resin | 20 |
| natural rubber | 10 |
| zinc white | 10 |
| titanium oxide | 10 |
| stearic acid | 1.0 |
| sulfur | 1.5 |

and, after heat compression molding at about 85° C. for 10 minutes, it was cured, and the thread-wound golf ball having the following cover F was produced.

Cover F balata cover cover hardness JIS-C 76

Then, the performance of the obtained golf balls was evaluated. The results are shown in Tables 2 and 3.

TABLE 2

| | | Example | | | | |
|---|---|---|---|---|---|---|
| | | 1 | 2 | 3 | 4 | 5 |
| Cover | | E | E | D | C | E |
| | Hardness (JIS-C) | 76 | 76 | 78 | 84 | 76 |
| | Thickness (mm) | 1.34 | 1.59 | 1.34 | 1.34 | 1.34 |
| Liquid center | | A | A | A | B | B |
| | Outside diameter (mm) | 28.0 | 28.0 | 28.0 | 29.0 | 29.0 |
| | Weight (g) | 17.8 | 17.8 | 17.8 | 17.8 | 18.7 |
| | Bag gauge (mm) | 2.0 | 2.0 | 2.0 | 2.3 | 2.3 |
| | Bag hardness (JIS-A) | 48 | 48 | 48 | 56 | 56 |
| Thread-wound core outside diameter | | 40.0 | 40.5 | 40.0 | 40.0 | 40.0 |
| Golf ball | Hardness | 2.80 | 2.78 | 2.75 | 2.80 | 2.82 |
| | Outside diameter (mm) | 42.68 | 42.69 | 42.68 | 42.68 | 42.68 |
| | Weight (g) | 45.1 | 45.2 | 45.1 | 45.2 | 45.2 |
| W #1 HS = 45 | Initial velocity (m/s) | 66.1 | 66.3 | 66.1 | 66.2 | 66.1 |
| | Spin (rpm) | 3070 | 3120 | 3000 | 3100 | 3180 |
| S/W HS = 20 | Spin (rpm) | 6450 | 6600 | 6300 | 6350 | 6750 |
| | Cut resistance | 320 | 200 | 340 | 360 | 320 |

TABLE 3

| | | Comparative Example | | | | | | | |
|---|---|---|---|---|---|---|---|---|---|
| | | 1 | 2 | 3 | 4 | 5 | 6 | 7 | 8 |
| Cover | | A | A | A | B | E | B | B | F |
| | Hardness (JIS-C) | 92 | 92 | 92 | 89 | 76 | 89 | 89 | 76 |
| | Thickness (mm) | 1.59 | 1.34 | 1.09 | 1.59 | 1.59 | 1.59 | 1.59 | 1.09 |
| Liquid center | | C | C | C | C | C | A | B | D |
| | Outside diameter (mm) | 28.0 | 28.0 | 28.0 | 28.0 | 28.0 | 28.0 | 29.0 | 28.0 |
| | Weight (g) | 17.8 | 17.8 | 17.8 | 17.8 | 17.8 | 17.8 | 18.7 | 16.8 |
| | Bag gauge (mm) | 2.3 | 2.3 | 2.3 | 2.3 | 2.3 | 2.0 | 2.3 | 2.0 |
| Thread-wound core outside diameter | | 39.5 | 40.0 | 40.5 | 39.5 | 39.5 | 39.5 | 39.5 | 40.5 |
| Golf ball | Hardness | 2.69 | 2.80 | 2.75 | 2.75 | 2.84 | 2.78 | 2.75 | 2.80 |
| | Outside diameter (mm) | 42.68 | 42.68 | 42.69 | 42.68 | 42.69 | 42.69 | 42.68 | 42.69 |
| | Weight (g) | 45.2 | 45.2 | 45.2 | 45.1 | 45.1 | 45.1 | 45.2 | 45.2 |
| W #1 HS = 45 | Initial velocity (m/s) | 66.2 | 66.3 | 66.4 | 65.9 | 65.8 | 65.9 | 65.9 | 66.0 |
| | Spin (rpm) | 2800 | 2880 | 2950 | 2980 | 3280 | 2900 | 2950 | 3100 |
| S/W HS = 20 | Spin (rpm) | 4800 | 4990 | 5180 | 5350 | 6690 | 5150 | 5320 | 6650 |
| | Cut resistance | 500 | 360 | 280 | 470 | 420 | 490 | 490 | 100 |

* Cut resistance:

Using a No. 9 iron, the center of each 20 balls was hit at a head speed of 30 m/s, and the number of the balls which were not cut was counted. In this case, the index was given, the number in Comparative Example 8 being as 100.

* Golf ball hardness:

Amount of deformation of ball at the time of 100 kg load (mm).

* Initial velocity:

The hit velocity of the ball when hit using W#1 (driver) at a head speed of 45 m/s. An average value of n=12 was taken.

* Spin:

The amount of spin when hit at HS (head speed, m/s) in the Table using W#1, S/W (sand wedge). An average value of n=12 was taken.

EFFECT OF THE INVENTION

The thread-wound golf ball of the present invention has a little spin and a great fly distance in the shot by the driver etc. and has good spin characteristics in approach shot, and yet is superior in cut resistance. Japanese Patent Application No. 5-340861 is incorporated herein by reference.

What is claimed is:

1. A thread-wound golf ball having a liquid center wound by rubber thread and further having a cover placed thereon, wherein the major component of the cover is an ionomer whose JIS-C hardness is 70–85, and wherein the thickness of the cover is 1.0–1.8 mm, the outside diameter of the liquid center is 27–30 mm, the center bag hardness of the liquid center, in terms of JIS-A hardness, is 44–62, and the thickness of the center bag is 1.8–2.3 mm.

* * * * *